US005414453A

United States Patent [19]

Rhoads et al.

[11] Patent Number: 5,414,453

[45] Date of Patent: May 9, 1995

[54] USE OF A DENSITOMETER FOR ADAPTIVE CONTROL OF PRINTHEAD-TO-MEDIA DISTANCE IN INK JET PRINTERS

[75] Inventors: W. Wistar Rhoads, Escondido; Brent W. Richtsmeier, San Diego, both of Calif.

[73] Assignee: Hewlett-Packard Company, Palo Alto, Calif.

[21] Appl. No.: 145,019

[22] Filed: Oct. 29, 1993

Related U.S. Application Data

[63] Continuation-in-part of Ser. No. 56,330, Apr. 30, 1993.

[51] Int. Cl.[6] ..... B41J 2/09

[52] U.S. Cl. ..... 347/8; 347/19

[58] Field of Search ..... 347/19, 8

[56] References Cited

U.S. PATENT DOCUMENTS

| | | | |
|---|---|---|---|
| 5,065,169 | 11/1991 | Vincent et al. | 347/8 |
| 5,187,497 | 2/1993 | Hirano et al. | 347/8 |
| 5,227,809 | 7/1993 | Carpenter et al. | 347/8 |

*Primary Examiner*—Benjamin R. Fuller
*Assistant Examiner*—Valerie Ann Lund

[57] ABSTRACT

In order to optimize print quality, it is desirable to minimize the distance between a inkjet printhead and the media that is being printed on. Color inkjet printers commonly employ a plurality of print cartridges, usually either two or four, mounted in the printer carriage to produce a full spectrum of colors. In a multiple printhead printer, it is advantageous if the black print cartridge is closer to the print media when printing text than is the color cartridge when printing color graphics. Accordingly, a pen pen carriage with adjustable printhead-to-media spacing is disclosed. A controller tells the printer to decrease the printhead-to-media spacing when text printing is being performed and to increase the printhead-to-media spacing to the appropriate printhead-to-media distance when printing color graphics or large black area fills based on the density of ink being deposited. Thus, the controller constantly monitors what the pens will be doing to determine when the pens need to be moved closer to, or farther from, the paper. The apparatus and method enables the black printhead in a multiple cartridge color inkjet printer to be as close to the media as possible so that black text print quality will be optimized.

9 Claims, 13 Drawing Sheets

USE OF A DENSITOMETER FOR ADAPTIVE CONTROL OF PRINTHEAD-TO-MEDIA DISTANCE IN INK JET PRINTERS

CROSS-REFERENCE TO RELATED APPLICATIONS

The present invention is a continuation-in-part of copending and commonly assigned U.S. Pat. application DENSITOMETER FOR ADAPTIVE CONTROL OF INK DRYING TIME FOR INKJET PRINTER, by Jason Arbeiter, Ser. No. 08/056,330, filed Apr. 30, 1993; The present invention is related to the following copending and commonly assigned U.S. patent applications: ADJUSTABLE PEN-TO-PAPER SPACING IN PRINTERS USING BLACK AND COLOR PENS, by Thomas Linder, et al., Ser. No. 08/145,354, filed Oct. 29, 1993,; ADAPTIVE CONTROL OF SECOND PAGE PRINTING TO REDUCE SMEAR IN AN INKJET PRINTER, by Jason Arbeiter, et al., Ser. No. 08/056,338, filed Apr. 30, 1993; BLACK TEXT QUALITY IN PRINTERS USING MULTIPLE BLACK AND COLOR PENS, by Wistar Rhoades, et al., Ser. No. 08/056,959, filed May 3, 1993; CARRIAGE SUPPORT FOR COMPUTER DRIVEN PRINTER, by Damon W. Broder, et al., Ser. No. 08/056,639, filed Apr. 30, 1993; IMPROVED MEDIA CONTROL AT INK-JET PRINTZONE, by Robert R. Giles, et al., Ser. No. 08/056,229, filed Apr. 30, 1993. The foregoing commonly assigned and copending applications are herein incorporated by reference.

FIELD OF THE INVENTION

This invention relates generally to the field of thermal inkjet printers and more particularly to improving black text quality in thermal inkjet printers using multiple black and color inkjet pen cartridges.

BACKGROUND OF THE INVENTION

Inkjet printers have gained wide acceptance. These printers are described by W. J. Lloyd and H. T. Taub in "Ink Jet Devices," Chapter 13 *of Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet printers print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as a inkjet firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Color inkjet printers commonly employ a plurality of print cartridges, usually either two or four, mounted in the printer carriage to produce a full spectrum of colors. In a printer with four cartridges, each print cartridge contains a different color ink, with the commonly used base colors being cyan, magenta, yellow, and black. In a printer with two cartridges, one cartridge usually contains black ink with the other cartridge being a tricompartment cartridge containing the base color cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

When a number of pixels in a particular area of an absorbent print medium such as bond paper absorb the liquid solvent constituent (typically water) of the ink, the paper fibers in that area will expand until the solvent has evaporated or otherwise dispersed. Because the dampened area of the print medium is typically constrained in the plane of the paper by adjacent less damp areas and/or by the paper advance mechanism and from below by a platen, the dampened area has a tendency to buckle upwards towards the nozzle (a problem referred to as "cockle"). If the height of the buckle exceeds the nominal spacing between the pen and the paper, then the ink in that area will be scraped by the pen as the pen retraces over some or all of the buckled area during a subsequent sweep over the same in the opposite direction (bidirectional and certain color printing modes) or prior to printing a sweep over an overlapping area (multiple pass printing modes). Such scraping causes smearing of the still damp ink and a degradation of image quality.

A related problem is "curling" of the paper. As a result of the differential absorption of solvent on the two sides of the paper, once the paper exits from the feed mechanism, it is no longer under tension and has a tendency to curl. Depending upon the extent of the curl, which is a function of both overall image density and throughput speed, the printed surface will be urged against various stationary parts of the printer between the carriage and the output tray, and at least the densest parts of the image will be smeared.

The print medium becomes damper and remains damp for a longer time as more ink is applied on the same area of the print medium. Thus, the probability of buckling or curling increases when ink density of a print image increases to produce intense black or colored portions of the image. The probability of smearing also increases when the speed of the printer increases and less time is allowed for the ink to dry, or when the distance between the paper and the nozzle is reduced to more accurately define the size and location of the individual dots of ink. Problems associated with scraping of the nozzles against the raised portions of the image are most noticeable during high quality multiple pass printing modes in which the nozzle passes several times over the same area. The curling problem is particularly noticeable in high quality, high throughput (single pass) printing modes in which a large quantity of ink is deposited over a relatively large area in a relatively short time.

Prior printers were designed so that each printhead was the same distance from the media. The distance was determined by adding up the various tolerances such as media cockle height, tolerance between the parts that define the position of the media and the carriage, tolerance from printhead location to printhead location within the carriage, and variation in the distance from the closest part of the printhead to the media to the surface on the print cartridge that locates the printhead in the carriage. These tolerances can require a nominal printhead to media distance that does not produce good print quality due to the increased effects of spray and errors in the nominal trajectory of the main drop.

Moreover, this does not yield optimum print quality for a black and color printer, since the nominal printhead to media distance is identical for the black and color pens. Black text print quality is more sensitive to printhead to media spacing than color graphics and images are, therefore having the black printhead further from the media than the color printhead(s) and all the printheads far enough from the media to prevent scraping will produce a lower print quality than could be achieved if it was possible for the black printhead to be closer to the print media.

One known solution of the scraping problem is to increase the spacing between the pen and the print medium. However, because such an increase in spacing would reduce the precision and sharpness of the ink drops and thus degrade the print quality, that solution is not satisfactory for printing high quality graphics applications.

Another known solution of the smearing problem is to accelerate the evaporating of the solvent by heating the print medium as it is being printed and/or circulating dry air over the freshly printed image; however excessive heating interferes with the proper adherence between the ink and the print medium, and may also cause the less densely inked areas to shrink and/or to become brittle and discolored. These problems may also be avoided by providing a relatively long fixed time delay between successive sweeps by the pen. However, such a solution would decrease the throughput of the printer. At a time when the industry is in a pursuit to increase the throughput of printers so that they can keep up with the increasing throughput of central processing units, such a solution is unsatisfactory.

Thus, the prior art has failed to provide a satisfactory solution for printing a high quality graphics image at a high throughput rate, which is further exacerbated if additional dots of ink are selectively applied between adjacent pixels, thereby effectively doubling the number of dots of ink, in order to increase image density and/or to provide a smoother boundaries for any curved or diagonal images ("Resolution Enhancement Technology").

SUMMARY OF THE INVENTION

In order to optimize print quality, it is desirable to minimize the distance between a inkjet printhead and the media that is being printed on. This reduces print quality degradation by spray (small, stray drops of ink with different trajectories than the main drop) and errors in the nominal trajectory of the main drop. Color inkjet printers commonly employ a plurality of print cartridges, usually either two or four, mounted in the printer carriage to produce a full spectrum of colors. In a multiple printhead printer, it is advantageous if the black print cartridge is closer to the print media when printing text than is the color cartridge when printing color graphics.

In accordance with this invention, pen carriage has adjustable printhead-to-media spacing. A controller tells the printer to decrease the printhead-to-media spacing when text printing is being performed and to increase the printhead-to-media spacing to the appropriate printhead-to-media distance when printing color graphics or large black area fills based on the density of ink being deposited. Thus, the controller constantly monitors what the pens will be doing to determine when the pens need to be moved closer to, or farther from, the media.

An inkjet printer according to one aspect of the present invention comprises a carriage mounted inkjet printing mechanism for applying liquid ink to a print medium as successive columns of dots contained within a horizontal swath to thereby form a portion of the image. A drive mechanism is .provided for moving the carriage horizontally relative to the print medium to thereby move the printhead across a horizontal swath. A drive mechanism is provided for moving the carriage vertically relative to the print medium to thereby adjust the printhead-to-media distance. The printer also comprises a controller which inhibits the drive mechanism from moving the carriage across the horizontal swath until the appropriate printhead-to-media distance has been set, wherein the printhead-to-media distance is a variable distance determined by the print mode and the maximum density of the ink which will be deposited in the horizontal swath.

In accordance with this invention, optimum printhead-to-media spacing for text printing is attained in a multiple pen black and color printer, since color graphics or large black area fills no longer control the text printhead-to-media spacing. The apparatus and method of this invention enables the black printhead in a multiple cartridge color inkjet printer to be as close to the media as possible so that black text print quality will be optimized.

DETAILED DESCRIPTION OF THE PREFERRED EMBODIMENT

Figure 1:
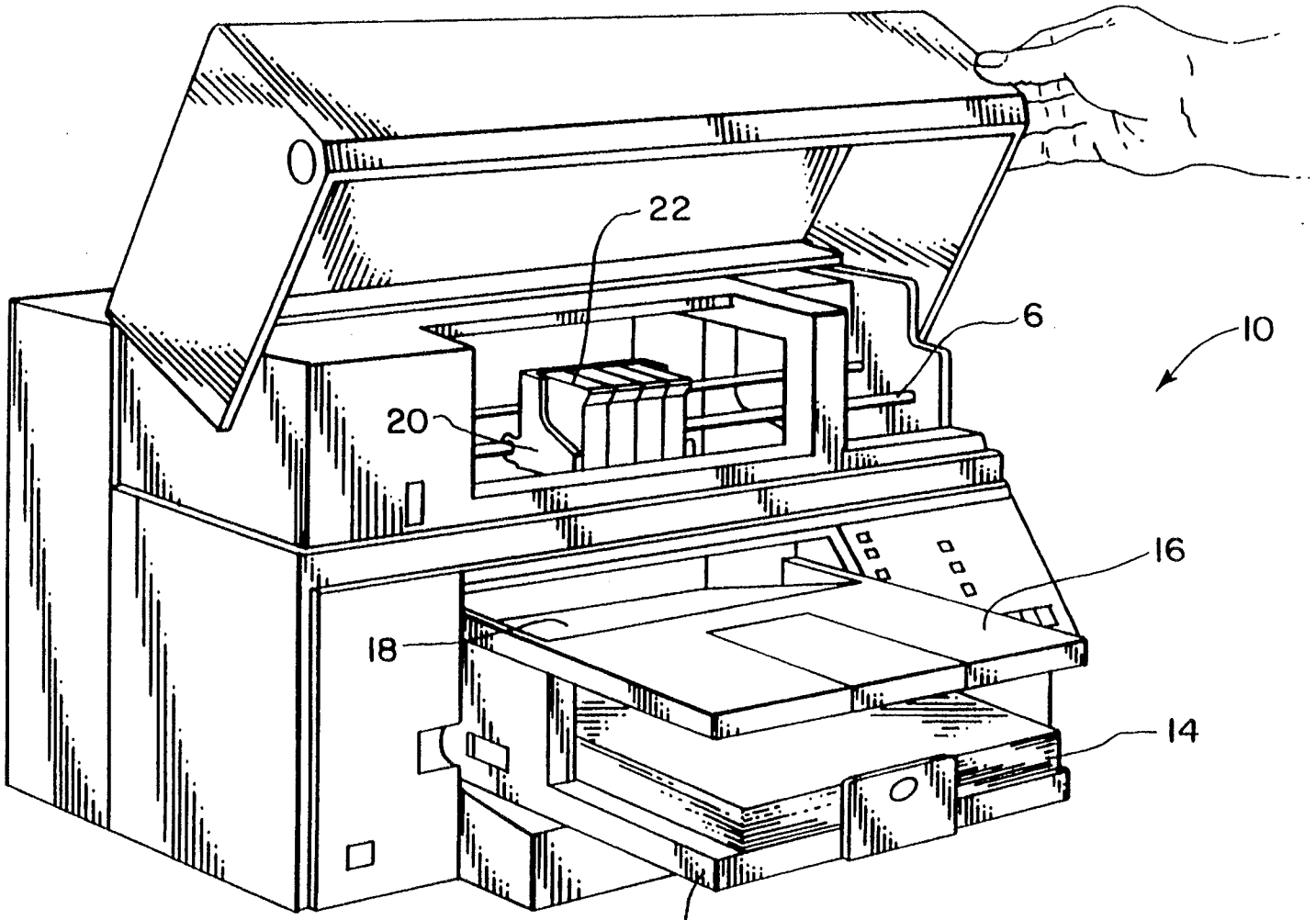
FIG. 1 is a perspective view showing a inkjet printer incorporating the present invention.
Figure 3:
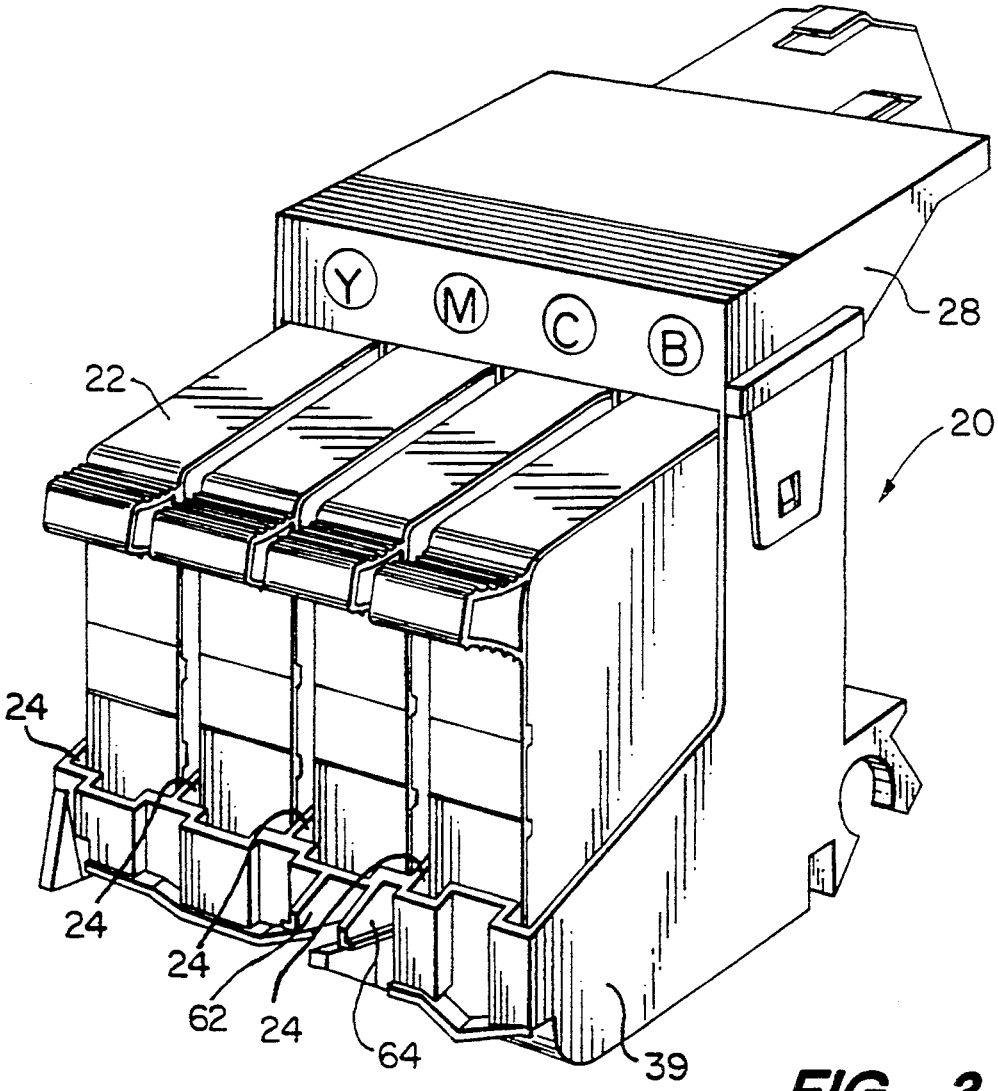
FIG. 3 is a perspective view of a inkjet printer carriage.

FIG. 1 shows a color inkjet printer 10 incorporating the present invention. In particular, inkjet printer 10 includes a movable carriage assembly 20 supported on slider rod 6 at the rear and a slider bar (not shown) at the front. Inkjet printer 10 also is provided with input tray 12 containing a number of sheets of paper or other suitable ink receiving medium 14, and an upper output tray 16 for receiving the printed media 18. As shown in FIG. 3, movable carriage 20 includes a plurality of individual cartridge receptacles 24 for receiving a respective plurality of thermal ink jet printer cartridges 22.

Figure 2:
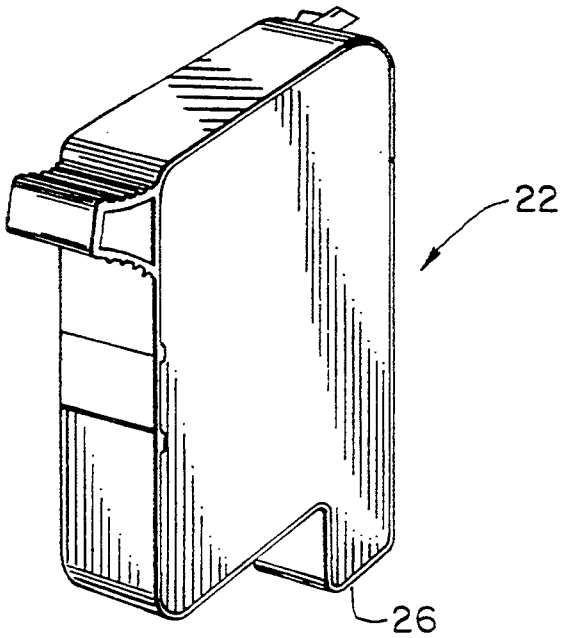
FIG. 2 is a perspective view of a inkjet cartridge in accordance with this invention.

FIG. 2 is a more detailed illustration of an inkjet pen cartridge 22 that stores ink and has a printhead 26 which when activated by firing pulses causes ink to be ejected from nozzles in the inkjet pen printhead 26. At the bottom of printhead 26 is an encapsulant (not shown) which covers the wire leads at the edges of the printhead 26. The encapsulant is closer to the media than the nozzles in the printhead 26. As used herein, the printhead-to-media or printhead-to-media spacing or distance refers to the encapsulant to paper spacing or distance. FIG. 3 illustrates four inkjet pen cartridges 22 installed in four ink cartridge receptacles 24 in carriage assembly 20 and with carriage cover 28 installed on top of carriage assembly 20.

Figure 4:
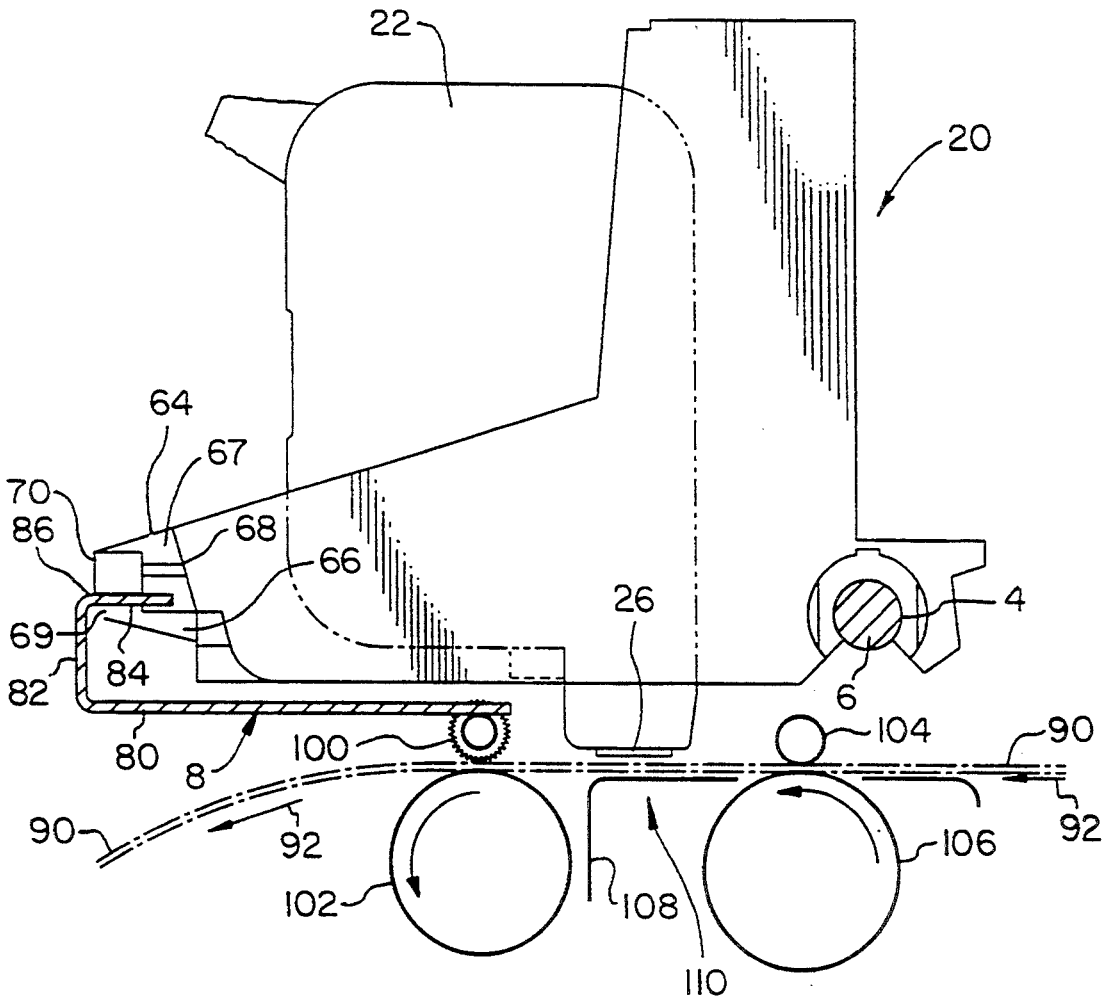
FIG. 4 is a right side elevation view of the carriage of FIG. 3 showing the slider rod and slider bar supports and a portion of the media feed path of the printer of FIG. 1 partly in cross-section.

FIG. 4 shows carriage assembly 20 mounted for sliding movement on slider rod 6 and slider bar 8 which each extend transversely of the path of movement of the paper or other printing medium through the printer. In the embodiment shown, the carriage 20 is supported in the rear on slider rod 6 by two laterally spaced bushings 4 in the lower rear portion of the carriage 20 and in the front by slider bar 8 the upper surface of which comprises a carriage support surface 86 which engages the lower surface of the slider shoe 70 to support the front portion of the carriage 20.

Figure 6:
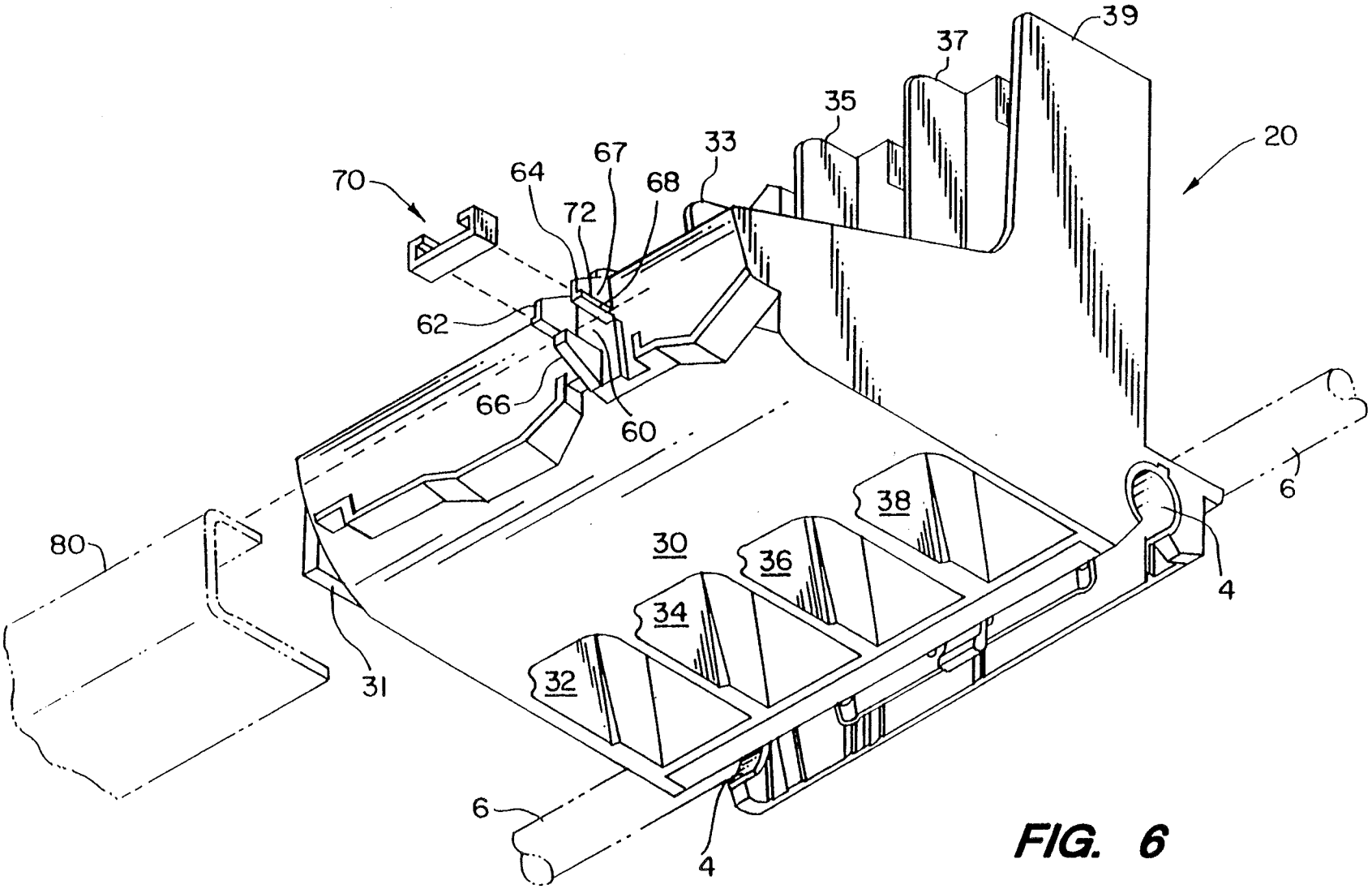
FIG. 6 is a perspective view showing the underside and the right hand side of a printer carriage mountable for sliding movement on a slider rod and slider bar shown in phantom.

FIG. 6 shows a perspective view from the bottom front of carriage assembly 20. In the preferred embodiment, four separate inkjet cartridges 22 are provided for cyan, magenta, yellow and black inks. The carriage 20 comprises a molded plastic member comprised of five generally L-shaped parallel spaced plates 31, 33, 35, 37 and 39 which define four ink cartridge receptacles 24 therebetween. The ink cartridges 22 have printed circuits mounted on their back walls which receive electrical pulses from the printer carriage 20 to energize the printheads 26 (FIG. 2) eject ink drops therefrom. The carriage 20 also has an integrally formed bottom wall 30 provided with four apertures 32, 34, 36 and 38 which receive the narrow snout portion of the ink cartridges 22 containing the printhead 26. Ink is ejected downwardly from nozzles (not shown) in printhead 26 onto the paper or other media.

Figure 5:
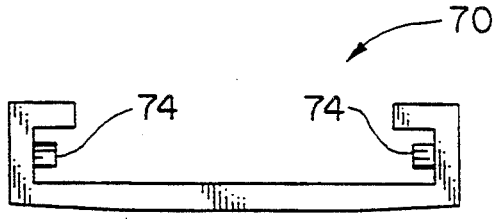
FIG. 5 is an enlarged view of the slider shoe used on the carriage.

Referring to FIGS. 4, 5 and 6, each of the two upper slider bosses 62, 64 on the front wall of carriage 20 has a vertically extending web 67 and an outwardly extending horizontal flange 68 for the purpose of receiving replaceable shoe 70. Each of the flanges 68 has a slight indent (not shown) for reception of a projecting dimple 74 on two opposed flanges of the slider shoe 70 which comprises a channel shaped plastic section whereby slider shoe 70 can be slipped onto the horizontal flanges 68 of the upper bosses 62, 64 wherein the dimples 74 (FIG. 5) will retain the slider shoe 70 on the flanges 68 by engaging the indents 72 therein.

The lower boss 66 on the front wall of the carriage 20 preferably has an upper contact lip 69 (FIG. 4) which does not extend the full length of the boss. The lip 69 and the lower surface of the wear slider shoe 70 are spaced a distance to closely slideably receive an upper flange of the slider bar 8.

Referring to FIG. 4, the slider bar 8 preferably is fabricated from a single piece of sheet metal formed as a channel member having a relatively wide lower flange 80, a vertically extending connecting web 82 and a relatively narrow horizontally extending upper flange 84, the upper surface of which comprises a carriage support surface 86 which engages the lower surface of the slider shoe 70 to support the front portion of the carriage 20. Preferably, the carriage support surface 86 has a high molecular weight polyethylene coating thereon. This coating may be conveniently applied as a strip of tape although other means lubricating the support surface 86 of the slider bar can of course readily be devised by persons skilled in the art.

Referring to FIG. 4, a small portion of the paper path through the printer 10 is illustrated. Each cartridge 22 is supported above the media 90 by the carriage assembly 20 and cartridge receptacle 24, such that printhead 26 is maintained an appropriate printhead-to-media distance from the media 90. The paper 90 is picked from the input tray 12 (FIG. 1) and driven into the paper path in the direction of arrow 92. The leading edge of the paper 90 is then fed into the nip between drive roller 106 and idler or pinch roller 104 and is driven into the print zone 110. A grill screen 108 supports the paper 90 as it is passed through the print zone 110 under printhead 26. After the paper passes through the print area 110 it encounters output roller 102, which propels the media 90 into the output tray 16 (FIG. 1). The drive roller 106 and output roller 102 maintain the print media 90 in a taut condition as it passes under the printhead 26, and advances in a direction perpendicular to the carriage 20 axis defined by slider rod 6.

In the print zone 110, printing onto the upper surface of the media 90 occurs by stopping the drive and output rollers 106, 102, moving the carriage 20 along a swath, and firing the ink cartridges to print a desired swath on the media surface. After printing the desired swath on the media 90 is completed, the drive and output rollers 106, 102 are actuated and the media 90 is driven forward by a swath length, and swath printing commences again.

The inkjet nozzles in printhead 26 are carried by carriage 20 which is driven along the support shaft by a mechanism which comprises, for example, a motor and a belt. The inkjet nozzles in printhead 26, when activated, apply droplets of ink onto the paper. Typically, the inkjet nozzles are mounted on the carriage in a direction perpendicular to the direction of the sweep, so that columns of dots are printed in one sweep. The columns of dots made by inkjet nozzles across a horizontal portion of the paper is sometimes called a swath. A swath may be printed by one or more passes of the inkjet nozzles across the same horizontal portion, depending upon the required print mode. In order to reduce undesirable "banding", some of the known printing modes advance the print medium relative to the carriage in the vertical direction by only a fraction of the height of a single swath. In order to reduce "bleeding", multipass printing modes may be used in which the dots applied in successive passes are interleaved vertically and horizontally. Moreover, both single pass and multiple pass print modes may employ "Resolution Enhancement Technology" in which additional dots of ink are selectively applied between adjacent pixels to increase image density and/or to provide smoother boundaries for curved or diagonal images.

When a swath is completely printed, the paper is advanced toward the output tray 16, with the assistance of starwheel 100 and an output roller 102 which cooperate to produce a pulling force on the paper. A starwheel is used so that its pointed edges can pull the paper at the printed surface without smearing.

Figure 7:
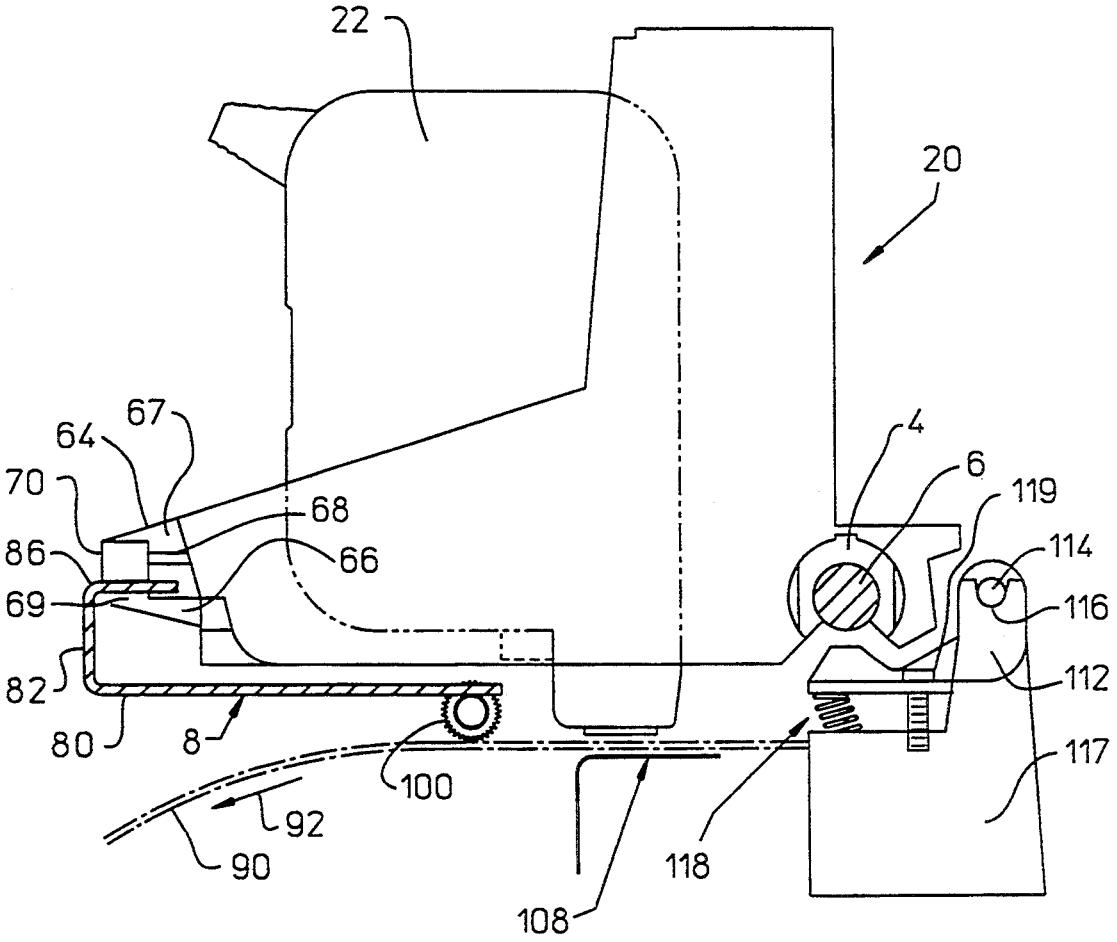
FIG. 7 is a side view, partly in cross-section, showing the carriage assembly and the printhead-to-media distance adjustment mechanism.
Figure 8:
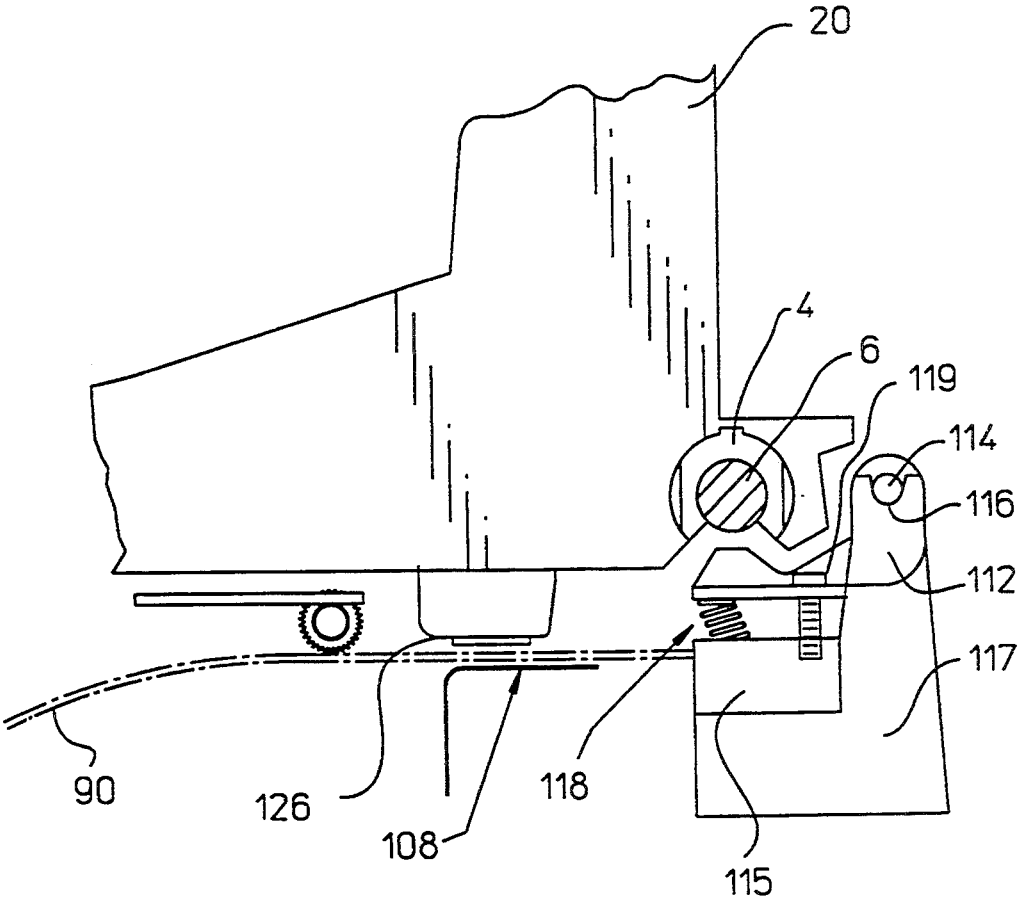
FIG. 8 is a side view, partly in cross-section, showing a printhead-to-media distance adjustment mechanism.
Figure 10:
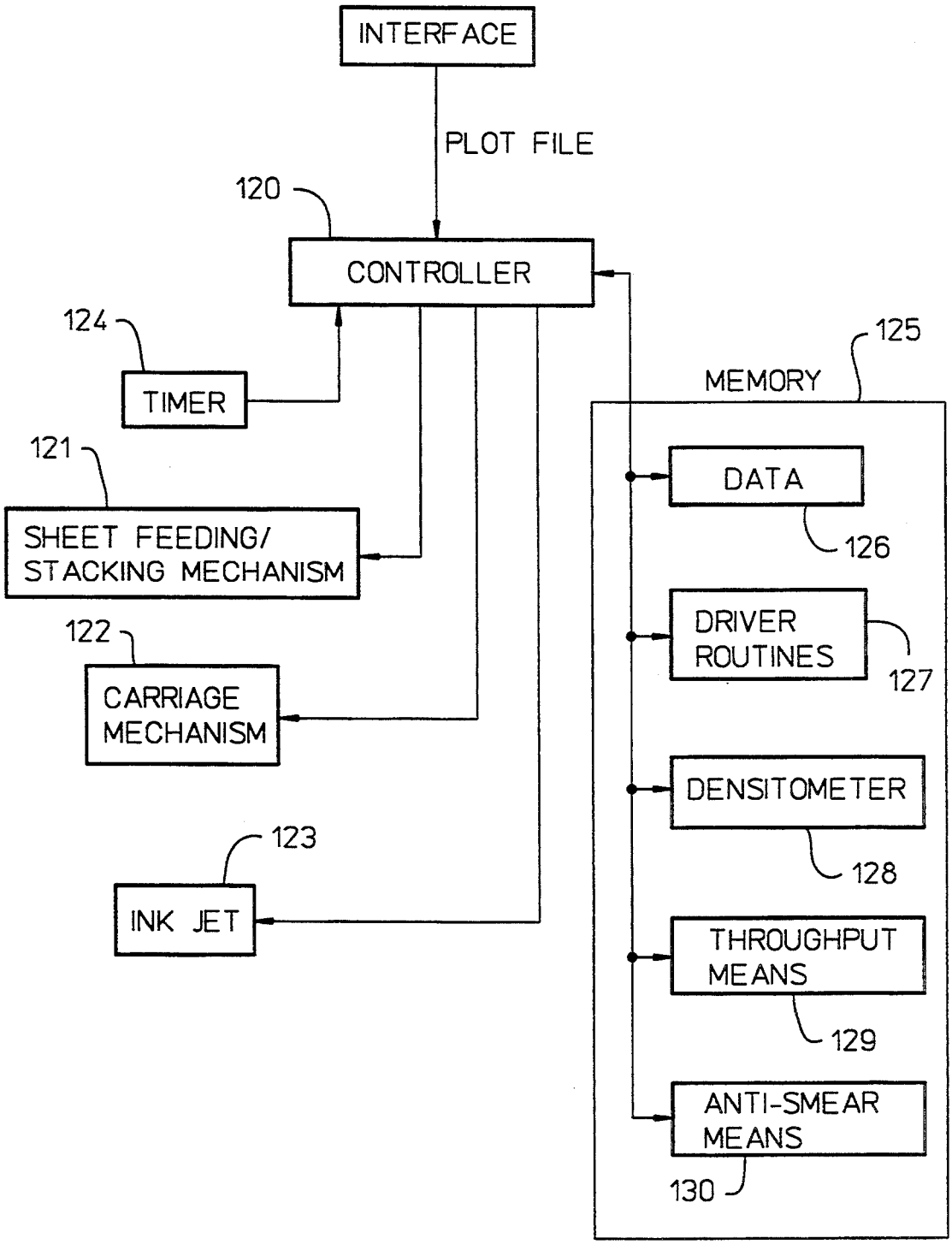
FIG. 10 is a block diagram of the main hardware components of an inkjet printer and the related software.

Referring to FIG. 7, the slider rod 6 is supported at two midpoints by two stamped sheet metal parts called rod mounts 112. Each rod mount 112 has a dowel pin 114 located on its upper back portion which are inserted in a groove 116 in the upwardly extending portion on the left and right printer chassis 117. The front of the rod mounts 112 on the left and right of the printer rest on adjustment springs 118. Referring to FIG. 8, the rod mount 112 and adjustment spring 118 are held with adjustment screws 119 to the top of the solenoid 115. By turning adjustment screws 119 at each side of the printer chassis while moving the carriage 20 to the left and right of the print zone the nominal minimum printhead-to-media distance can be adjusted. Solenoid 115 of carriage. mechanism 122 moves to an upper position to increase printhead-to-media distance and to a lower position to decrease the printhead-to-media distance in response to signals from controller 120 (See FIG. 10). Solenoid 115 allows for only two printhead-to-media-distances.

Figure 9:
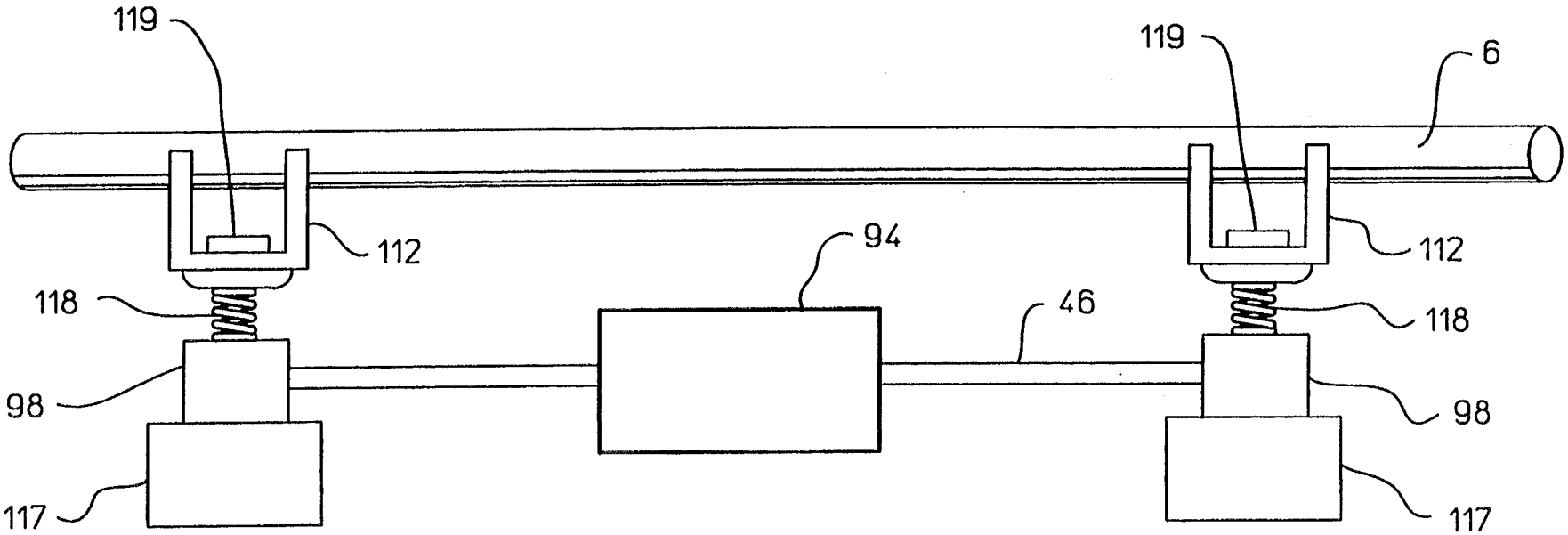
FIG. 9 is a front view showing an alternative printhead-to-media distance adjustment mechanism.

FIG. 9 shows an alternative embodiment which allows for an essentially unlimited number of printhead-to-media distances. A stepper motor 94 and drive shaft 96 are mounted parallel to and below slider rod 6. Drive shaft 96 is connected to gears or cams 98 below rod mounts 112 on the left and right sides of printer 10. The gears or cams 98 in response to rotary movement of drive shaft 96 in response to signals from controller 120 to stepper motor 94 cause rod mounts 112 and slider rod 6 to move up and down and the change the printhead-to-media distance.

The sum of all the tolerances associated with each individual printer part exceeds the tolerance on printhead-to-media distance required to obtain the desired text print quality. Hence, it is required to adjust the printhead-to-media distance on every printer. The establishment of the distance of the inkjet printhead above the paper from a strictly print quality point of view would be to have the printhead nearly brush the paper in order to achieve the maximum text print quality. Setting the ink cartridge so that there is a 0.8 mm printhead to media spacing produces excellent black text print quality, since the black cartridge never completely leaves the edge of the page during text printing. But it is not possible to print graphics at this printhead-to media distance because the printheads often leaves the page during graphics printing and will catch the edge of the paper on their return.

With respect to print quality, printhead-to media distances of 1.0 mm or less above the media are clearly excellent while printhead distances of 2.0 mm or more above the media are clearly unacceptable. Based upon applicable tolerances in a inkjet printer and the necessary compromise when both text and graphics are being printed, a nominal printhead-to media distance of 1.3 to 1.6 mm above the media provides the maximum benefit with respect to black text print quality while maintaining adequate clearance above the media during graphics printing.

Since the black print quality is more sensitive to printhead to media distance than is color image quality, the ability to decrease the black printhead-to-media distance when printing only text, will greatly increase black text quality and therefore overall output quality is optimized.

Figure 12:
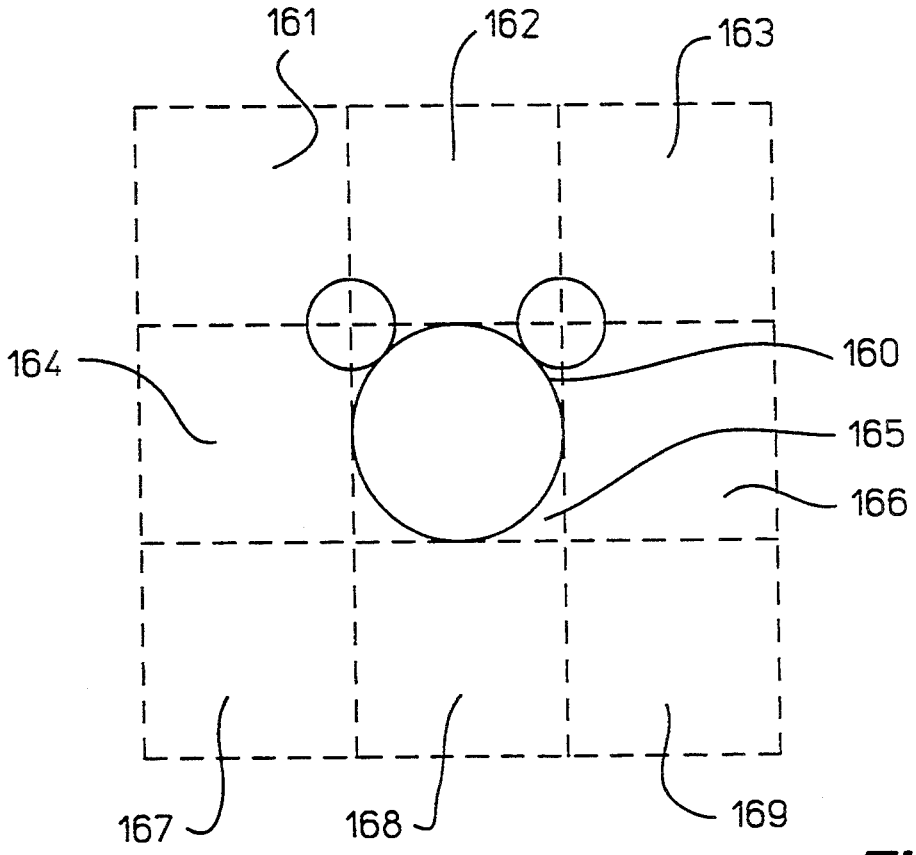
FIG. 12 shows how an image may be scanned by a non-overlap method.

FIG. 12 is a logic diagram showing the main hardware components of the printer 10 and the related software. The hardware components include a controller 120 which operates to control the main operations of the printer 10. For example, the controller controls the sheet feeding/stacking mechanism 121, including the pinch wheel 104, the main drive roller 106, the starwheel 100 and the output roller 102, to feed and position a sheet of paper during a printing process. The controller 120 also controls the carriage drive mechanism 122 to move the carriage across the paper and the solenoid 115 to adjust the printhead-to-media distance. The controller 120 also controls the inkjet nozzles 123 to activate them at appropriate times so that ink can be applied at the proper pixels of the paper.

The controller 120 performs the control functions by executing instructions and data accessed from a memory 125. For example, data to be printed are received by the printer 120 under the control of a software driver. The data received are stored in a "plot file" within a data area 126 in the memory 125.

The instructions can be classified logically into different procedures. These procedures include different driver routines 127 such as a routine for controlling the motor which drives the main drive roller, a routine for controlling the motor which drives the output roller/-star wheel, a routine for controlling the motor which drives the carriage and a routine for controlling activation of the inkjet nozzles.

One or more timers 124 are available to controller 120. A timer may be simply be a starting clock value stored at a predetermined location in the memory. To obtain an elapsed time value, the stored starting value is then subtracted from an instantaneous clock value from a real time clock (not shown).

The memory 125 also stores a throughput procedure 129. The throughput procedure operates to control the throughput of the printer 100. Throughput may be thought of as the sum of a first duration T1 and a second duration T2, where T1 is the time duration between the time immediately before a first swath is printed on a sheet of paper and the time immediately after the last swath is printed, and T2 is the time duration between the final position of one sheet and the initial position of the next sheet. T2 represents the sheet feeding delay of the printer, which is typically constrained only by the drive mechanism and is therefor a constant; however T1 is also constrained by various factors related to the complexity and density of the image and the desired print quality, which in turn determine how much time is required for each of the sequential process steps of the selected print mode. Throughput procedure 129 uses horizontal and vertical logic seeking to identify blank lines between adjacent swaths (vertical logic seeking) and blank portions at either end of (or possibly within) a swath, altogether avoiding any unnecessary carriage movements and moving the carriage at its maximum rate over any unprinted areas over which the carriage must be moved.

The memory 125 also stores a densitometer procedure 128 which determines a maximum density of dots of ink to be printed in the current swath, and a second page anti-smear procedure 130 which operates in response to the results from the densitometer procedure 128 to ensure that the ink of a preceding sheet of paper is not smeared when the current sheet of paper is output.

Typically, a sheet of paper is printed by applying ink at the specified dot positions (pixels). The dots may be printed in single (e.g., black) or multiple colors. To print a multiple color image, the carriage may have to make more than one sweep across the print medium and make two or more drops of ink with different primary colors at the same dot locations ("pixels"), as disclosed in U.S. Pat. No. 4,855,752 which is assigned to the assignee of the present invention.

The printer 10 has several different modes of printing. Each of the different modes is used to produce a different type or quality of an image. For example, one or more "high quality" modes can be specified whereby density of the print dots is increased to enhance the quality of the printed images. In some printers, a "high quality" mode of printing may require the printer 10 to make multiple passes across substantially the same horizontal portion of the page.

For example, in its high quality three pass mode, printer 10 make three sweeps across the page to print a single swath. In each of the three sweeps, the printer would print one of every three consecutive dots so as to allow more time for one dot to dry before the neighboring dot is printed, and thereby preventing the possibility that the ink of the two neighboring dots would combine to produce an unwanted shape or color. Such a three pass printing mode may also be used to reduce banding by dividing the swath into three reduced-height bands, printed in successive but overlapping printing cycles each providing for three passes across an associated reduced-height band.

In known manner, the image to be printed is defined by the "plot file" which specified which pixels are and which pixels are not to be coated with dots of ink. For color images, the color of the ink is also specified in the plot file.

Figure 17:
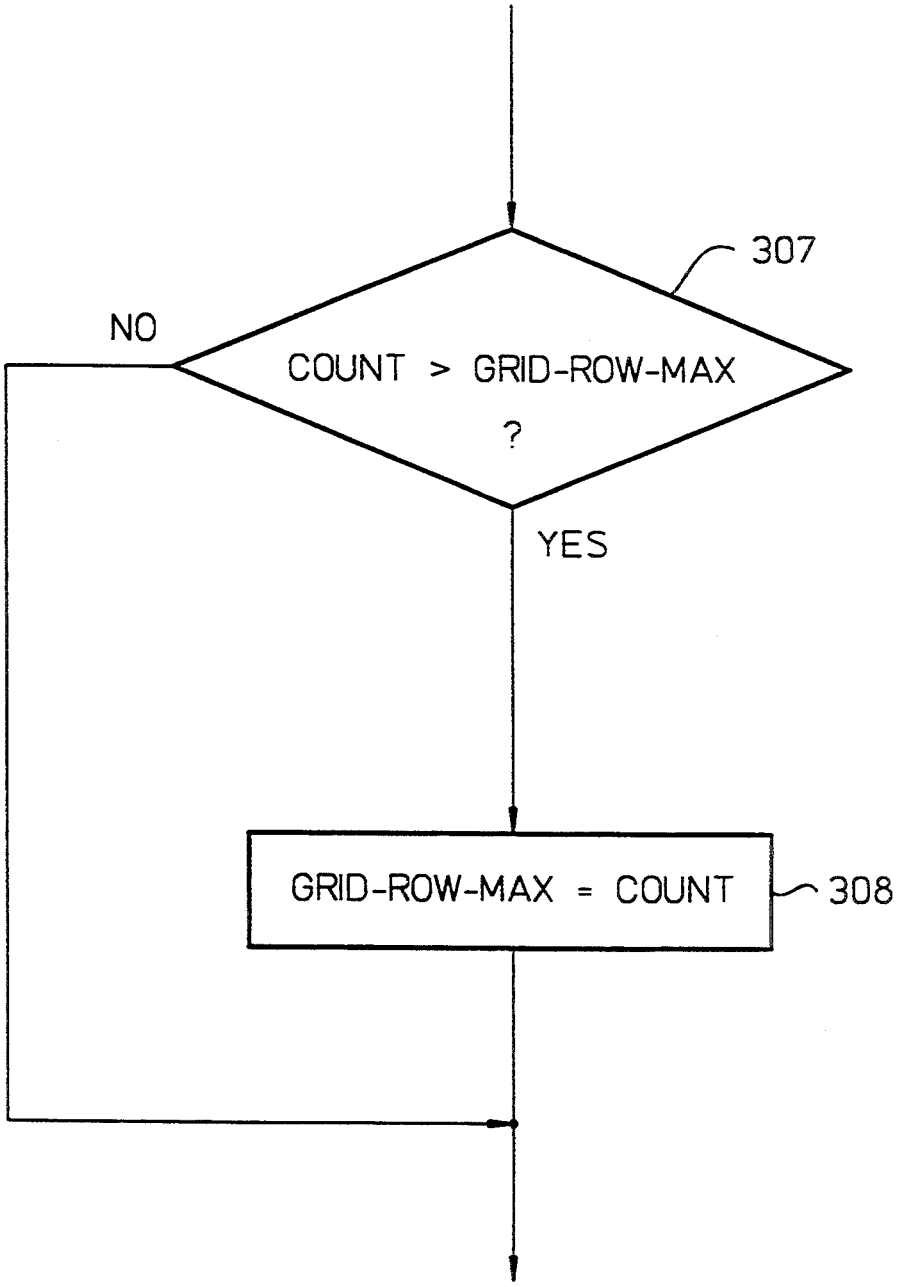
FIG. 17 is a flow chart showing the additional steps performed by the printer to find a grid with the maximum density in each row of grids.

FIG. 17 is a flow chart showing the general steps performed by the printer in printing an image. To print a page, a plot file is first sent to the printer 10 (step 201). As the plot file is being received by the printer 10, it is scanned by the controller 120. The controller 120 scans the plot file to divide it into one or more printed swaths and at the same time produces a density profile for the entire page (step 201).

More particularly, when the controller 120 scans the plot file, it also divides it into a plurality of grids each with a predetermined shape and size, each identified by an x-coordinate and a y-coordinate. For each grid, the controller 120 determines the number of dots that need to be printed with each type of ink.

According to one method, each swath to be printed in a single sweep of the carriage is subdivided into a plurality of rows and each row is subdivided into a plurality of non-overlapping grids; each dot on the page may belong to only one grid. The density of each grid is then determined by counting the number of pixels to be printed in a representative randomly selected sample of the pixels in the grid. An maximum row density is then obtained from the individual grid densities in each row, and a maximum sweep density is then obtained from the individual row densities in the sweep.

Figure 13:
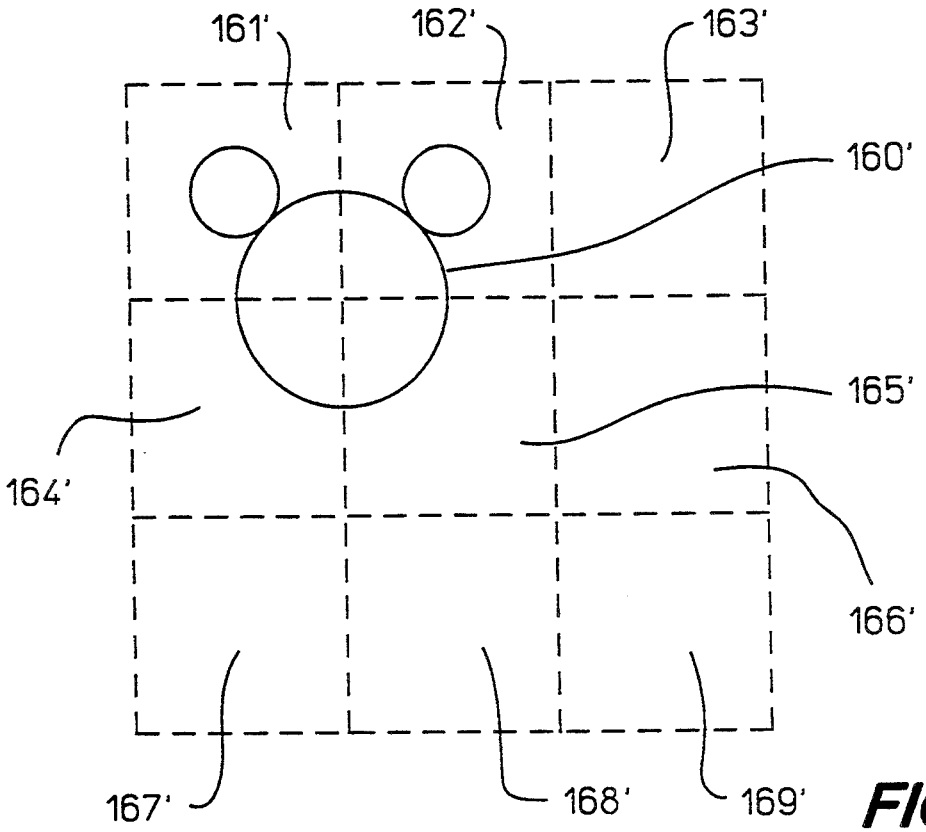
FIG. 13 shows how a difference may result in the method of FIG. 10 if the same image is scanned by the same non-overlap method when the position of the image changes.

Although such non-overlap scanning using only a representative sample is faster, it may, however, produce inaccurate results. To illustrate, assume an image to be printed by the printer has the shape 160 as shown in FIG. 12 and assume that the scanning is performed by square grids 161, 162, . . 169. Depending upon the position of the image 160 with respect to the grids, different density profiles may result. For example, if the image 160 falls by chance in the middle of a grid 165 as shown in FIG. 12 the density profile would show a high density, D1, in grid 165. On the other hand, if same image 160' per chance falls in the intersection of grids 161' 162' 164' and 165' as shown in FIG. 13, then the highest density of the image 160' would be about a fourth of the density D1 obtain from the scanning performed as shown in FIG. 12.

Moreover, accuracy of the local density profile is also a function of the size of the grid. For example, a density profile which is made with a non-overlapping grid size of 150×150 dots will more accurately reflect a dense image having a size of only 300×300 dots than a density profile which is made with a non-overlapping grid size of 300×300 dots. However, if grid size were so small that a single grid could have a density of 100% but the solvent could nevertheless rapidly diffuse into adjacent unprinted areas, such a small grid size would not provide a useful measure of the probability of an image being sufficiently dense to adversely affect print quality.

Figure 14:
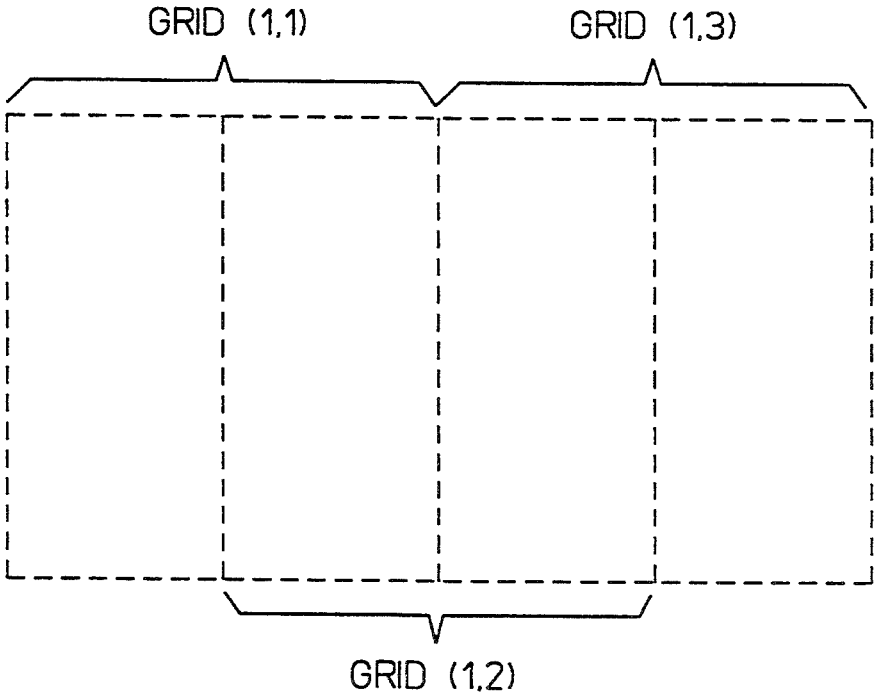
FIG. 14 shows how scanning can be overlapped horizontally to reduce differences caused by positional variations of an image.

However, more accurate measurement of the dot density may be obtained by overlapping the larger grids vertically and/or horizontally, to thereby obtain the advantages of both the larger and the smaller grid sizes. FIG. 14 shows how horizontal overlapping is performed with respect to three exemplary grids G(1,1), G(1,2) and G(1,3). As shown, the left half of grid G(1,2) overlaps right half of grid G(1,1). On the other hand, the right half of grid G(1,2) is overlapped by the left half of grid G(1,3).

Figure 15:
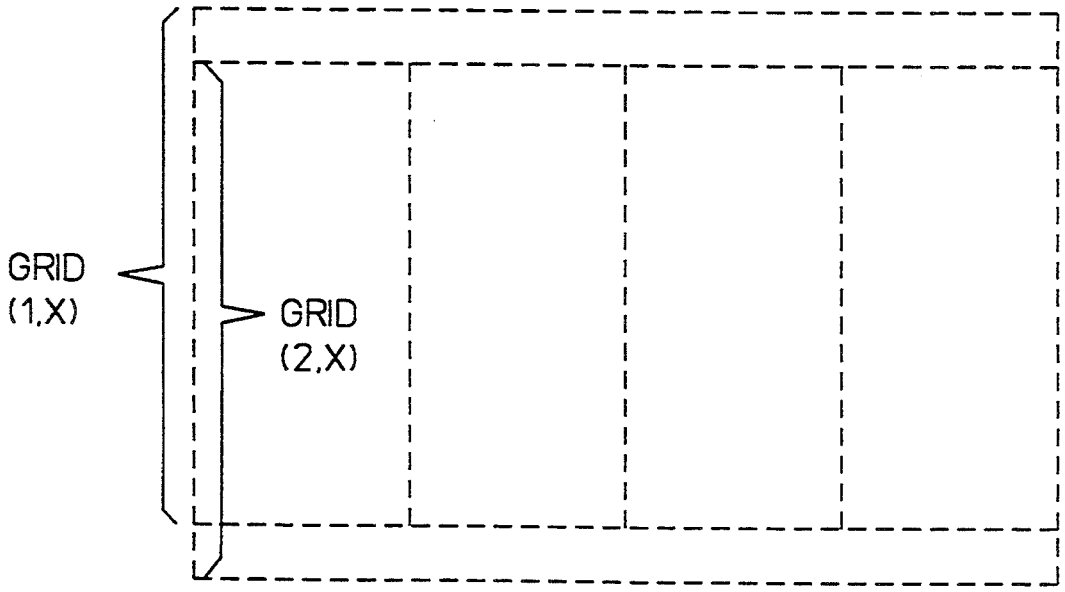
FIG. 15 shows how scanning can be overlapped vertically to reduce differences caused by positional variations of an image.

FIG. 15 shows how both vertical and horizontal overlapping may be combined. A first row of grids G(1,x), comprising grids G(1,1), G(1,2) and G(1,3) of FIG. 18 and a second row G(2,x) of grids which overlap with the first row G(1,x). For example, the upper 5/6 of grid G(2,1) in the second row overlaps the lower 5/6 of grid G(1,1) of the first row, and the upper 5/6 of grid G(2,2) overlaps the lower 5/6 of grid G(1,2).

Figure 16:
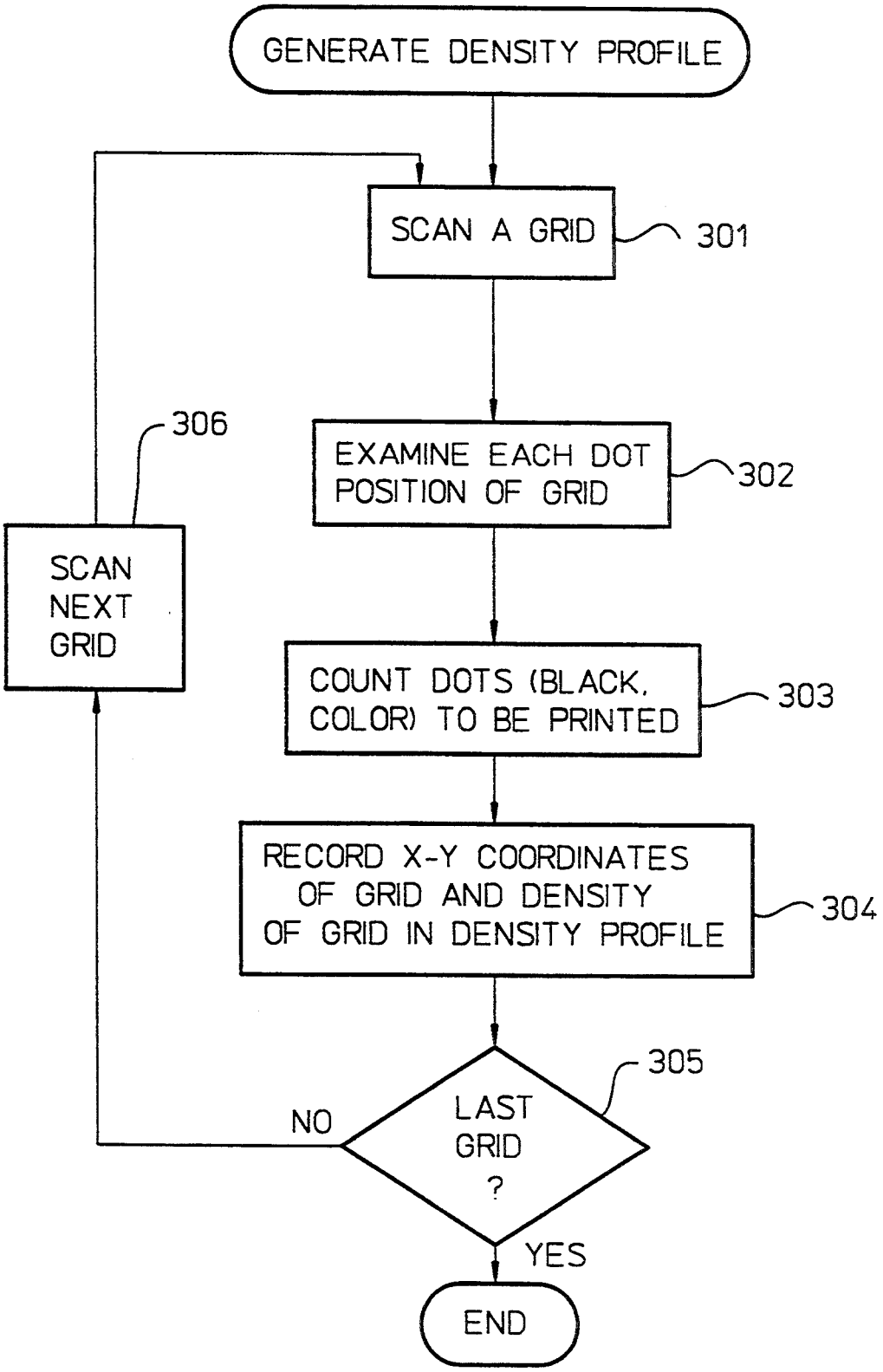
FIG. 16 is a flow chart showing the steps performed by the printer for generating a density profile of an image to be printed.

FIG. 16 is a flow chart illustrating the basic steps required to generate a density profile. The steps are performed by the densitometer procedure when it is executed by the controller 120.

In step 301, a grid of the image to be printed is scanned. In scanning the grid, each dot position of the grid is examined (step 302). Within the grid, the number of dot positions which will be printed with black dot and the number of dot positions which will be printed with colored dots are counted (step 303). Separate counts are made of black and colored dots because they are typically produced by inks having different formulations and concentrations. Because all the grids have the same size, the count can therefore be used directly to represent the density of the grip. After all the dot positions are examined, the count and the coordinates of the grid are stored into the memory 125 (step 304). The controller 120 then examines the plot file to determine whether the current grid is the last grid of the page (step 305). If the current grid is not the last grid, then the process is repeated on the next grid (step 306). Otherwise, the procedure terminates.

In practice, rather than maintaining a density history for each grid, only a maximum density for one or more rows of grids is stored, with the size of the individual grids preferably being preferably decreased. As a row of grids is being scanned, the grid with the maximum density in the row is located, along with its density value. This is accomplished by providing a variable, GRID-ROW-MAX, and the additional steps shown in FIG. 17 which are performed between steps 303 and 305. In step 307, the count obtained from step 303 is compared with the value stored in GRID-ROW-MAX. If the count of the current grid is greater than GRID-ROW-MAX, its value is stored into GRID-ROW-MAX (step 308); otherwise, step 308 is bypassed. It will be understood that GRID-ROW-MAX is initialized (by setting it to "0") at the beginning of the procedure shown in FIG. 17. If it is necessary to determine a maximum density for an area covering more than one grid row, this can be done by using a similar procedure to determine the maximum of the previously stored GRID-ROW-MAX values for each grid row involved. Alternatively, GRID-ROW-MAX is not re-initialized at the beginning of each row, but is re-initialized only once at the beginning of the area and is used until all the rows in that area have been processed. Similarly, if it is desired to determine a local density based on a grid size larger than that used to process the individual rows, this may be approximated by assuming that the maximum density locations in adjacent rows relate to adjacent portions of the image, and thus may be approximated by averaging the maximum densities of the adjoining rows; in any event, such an assumption would provide a calculated maximum density that is no less than the actual density.

Figure 11:
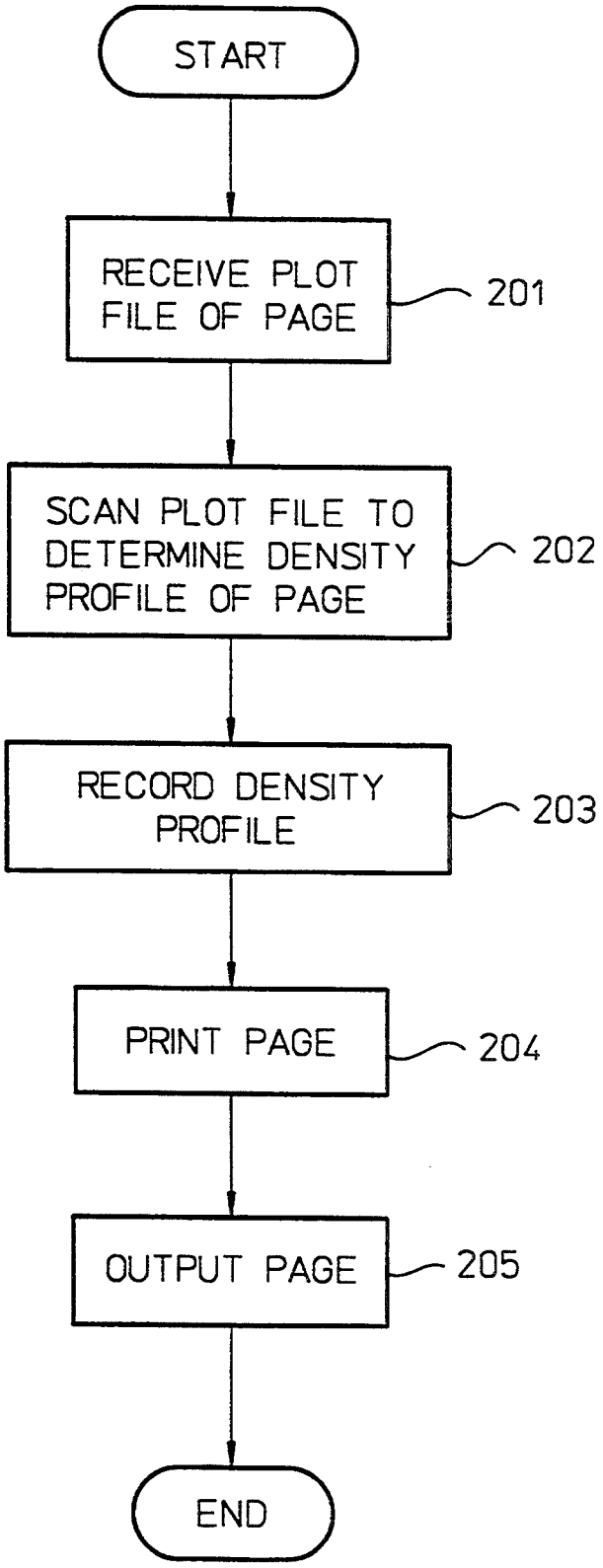
FIG. 11 is a flow chart showing the procedure performed in the printer to print an image.

The printhead-to-media distance cannot be changed during multiple sweeps of a swath or when using print modes which involve overlapping swaths. Also when printing in black text mode the pen can usually be set at the smallest printhead-to-media distance. In this situation the densitometer is usually not checked until the print mode is changed to a graphics mode. At the beginning of a new swath, the controller 120 checks to see if the print mode has been changed or if white space skipping has occurred. If so the controller determines what the maximum density is for the swath, page, or until next print mode change. Although a separate printhead-to-media distance could be calculated for each swath of the page, the required computations are simplified by determining only a single maximum density for the entire page, or print mode change and using that maximum density to calculate a worst case printhead-to-media distance. Referring back to FIG. 11, after the plot file is scanned and the required density information has been stored as a function of grid or row location, the page is printed (step 204).

The printhead-to-media distance required to prevent smearing of the previous swath can be determined by several methods. One such method is to perform a table look-up based upon the maximum density of the swath to find a minimum printhead-to-media distance required to prevent any possibility of smearing. In order to speed up and simplify the required computations, separate tables are preferably maintained for different papers and print modes; the table look-up is preferably performed using only the maximum density of the swath as determined in the densitometer procedure and preferably assumes a worst case condition that the maximum density is representative of average density over an area larger than a single grid. The controller 120 performs the table look-up to determine the printhead-to-media distance for the swath. The values of the table can be obtained empirically. Several sets of exemplary values are listed in the following tables:

| Density | Printhead-to-Media Distance (mm) |
|---|---|
| | Plain Paper |
| >150 | 1.4 |
| >75 | 1.2 |
| >25 | 1.0 |
| >0 | 0.8 |
| | Color Transparency |
| >150 | 1.2 |
| >75 | 1.1 |

-continued

| Density | Printhead-to-Media Distance (mm) |
|---|---|
| >25 | 1.0 |
| >0 | 0.8 |

It is understood that the above-described embodiment is merely provided to illustrate the principles of the present invention, and that other embodiments may readily be devised using these principles by those skilled in the art without departing from the scope and spirit of the invention.

What is claimed is:

1. An inkjet printer for printing an image on a print medium, comprising:

a chassis for supporting a carriage above said print medium;

an ink jet mechanism including at least one ink cartridge supported on said carriage, for applying liquid ink from a printhead on said cartridge to said print medium as successive columns of dots contained within a horizontal swath of said print medium to thereby form a portion of said image;

a carriage drive mechanism to move said carriage across said horizontal swath;

a cartridge drive mechanism for moving said cartridge vertically relative to said medium to thereby set a variable printhead-to-media-distance;

densitometer means for calculating a density of ink about to be deposited on said medium; and a controller responsive to the density calculated by the densitometer means for determining an optimized value for said printhead-to-media distance based at least in part on said density, and for causing said cartridge drive mechanism to set said variable distance between said medium and said printhead at said optimized value.

2. The inkjet printer of claim 1, wherein said controller inhibits said carriage drive mechanism from moving said carriage across said horizontal swath until the optimized value of the printhead-to-medium distance has been set by said cartridge drive mechanism.

3. The inkjet printer of claim 1, wherein said optimized value of the printhead-to-medium-distance for a relatively low density image is less than that for a relatively high density image.

4. The inkjet printer of claim 3, wherein said controller determines a maximum density of ink to be deposited and said optimized value is based at least in part on said maximum density.

5. The inkjet printer of claim 1, wherein said optimized value is also based on the ink in said cartridge, said print medium, and a print mode.

6. The inkjet printer of claim 5, wherein said optimized value of the printhead-to-medium-distance for text printing is less than that for graphics printing.

7. The inkjet printer of claim 5, wherein said optimized value of the printhead-to-medium-distance for printing with only black ink is less than that for a printing with one or more colored inks.

8. The inkjet printer of claim 5, wherein said optimized value of the printhead-to-medium-distance for printing on a transparent print medium is less than that for printing on a paper print medium.

9. The inkjet printer of claim 1, wherein said cartridge is supported at a fixed vertical distance relative to said carriage and said cartridge drive mechanism moves said carriage vertically relative to said chassis to thereby set said printhead-to-medium-distance.

* * * * *